United States Patent [19]

Galvin et al.

[11] 4,359,721

[45] Nov. 16, 1982

[54] TWO-WIRE MULTI-ZONE ALARM SYSTEM

[75] Inventors: Aaron A. Galvin; Roy L. Harvey, both of Lexington, Mass.

[73] Assignee: American District Telegraph Company, New York, N.Y.

[21] Appl. No.: 951,765

[22] Filed: Oct. 16, 1978

[51] Int. Cl.[3] ..... G08B 25/00; G08B 26/00

[52] U.S. Cl. ..... 340/525; 340/505; 340/506; 340/511; 340/537

[58] Field of Search ..... 340/525, 505, 506, 512, 340/508, 522, 509, 526, 527, 530, 521, 531, 533, 534, 536, 537, 538, 660–664, 511

[56] References Cited

U.S. PATENT DOCUMENTS

| | | | |
|---|---|---|---|
| 2,556,363 | 6/1951 | Lord et al. | 340/537 |
| 3,234,534 | 2/1966 | Todman | 340/505 |
| 3,482,243 | 12/1969 | Buchsbaum | 340/505 |
| 3,553,674 | 1/1971 | Head | 340/538 |
| 3,644,927 | 2/1972 | Green | 340/537 |
| 3,702,473 | 11/1972 | Fink | 340/511 |
| 3,716,834 | 2/1973 | Adams | 340/506 |
| 4,041,455 | 8/1977 | Norberg | 340/505 |

FOREIGN PATENT DOCUMENTS

| | | | |
|---|---|---|---|
| 1548526 | 7/1979 | United Kingdom | 340/506 |

*Primary Examiner*—John W. Caldwell, Sr.
*Assistant Examiner*—Donnie L. Grosland
*Attorney, Agent, or Firm*—Weingarten, Schurgin, Gagnebin & Hayes

[57] ABSTRACT

A multi-zone alarm system operative with a two-wire alarm loop and having a simple network at each alarm sensor for providing a coded signal indicative of sensor identity and relatively simple circuitry at a central location for interrogation of the remote sensors and determination of those sensors providing an alarm signal.

3 Claims, 6 Drawing Figures

OSC
66
DIVIDER
68
CURRENT SOURCE
70
72
74
60a
60b
62a
62b
END OF LINE NETWORK
76
PULSE DET.
78
DE-MUX
80
INT
82
CONTROL
84
EXCL OR
86
LATCH
88
LED DRIVER
90
LED
92
OR
94
CONTROL
96
NIGHT RELAY
98
DAY RELAY
100

CONSTANT CURRENT SOURCE
52
Va
I
1R
2R
3R
54a
54b
54c
RT
C3
R3
D1
58
READ CRT
54
MULTI-LEVEL COMPO.
56
ZONE OUTPUT

TWO-WIRE MULTI-ZONE ALARM SYSTEM

FIELD OF THE INVENTION

This invention relates to alarm systems and more particularly to a multi-zone alarm system for the detection and indication of an alarm condition in respectively identified zones.

BACKGROUND OF THE INVENTION

In alarm systems employed to sense intrusion, fire or other condition, techniques are known for the determination at a central location of the remote zone in which an alarm has occurred. In such systems, a communications path is established between each remote alarm sensor and a central location, the communication path being provided by means of a separate communications line from the central location to each remote station, or by use of a common communications line and multiplexed signaling techniques, such as time division multiplexing or frequency division multiplexing.

It is advantageous to employ a two-wire communications path forming a single alarm loop in which all alarm sensors are connected. Such a single loop can minimize the amount of wiring necessary to interconnect the central location with the remote sensors and can provide relatively simple and efficient connection of the remote sensors with the central location. It is usually required in an alarm system to provide the capability of identifying each sensor or each zone in which an alarm has occurred. Thus, a communication technique must be employed which is capable of identifying each sensor or each zone that senses an alarm condition.

SUMMARY OF THE INVENTION

In brief, the present invention provides a multi-zone alarm system operative with a two-wire alarm loop and having a simple network at each alarm sensor for providing a coded signal indicative of sensor identity and relatively uncomplicated circuitry at a central location for interrogation or polling of the remote sensors and determination of those sensors providing an alarm signal.

A current source is provided at the central location for providing a predetermined current in the alarm loop. The networks associated with respective alarm sensors are each operative in response to its sensor actuation to provide a signal for transmission along the loop to the central location, the signal having a characteristic which denotes the identity of the actuated sensor and its zone. These signals are received at the central location by circuitry operative to provide a signal indicative of the zone in which an alarm is sensed.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
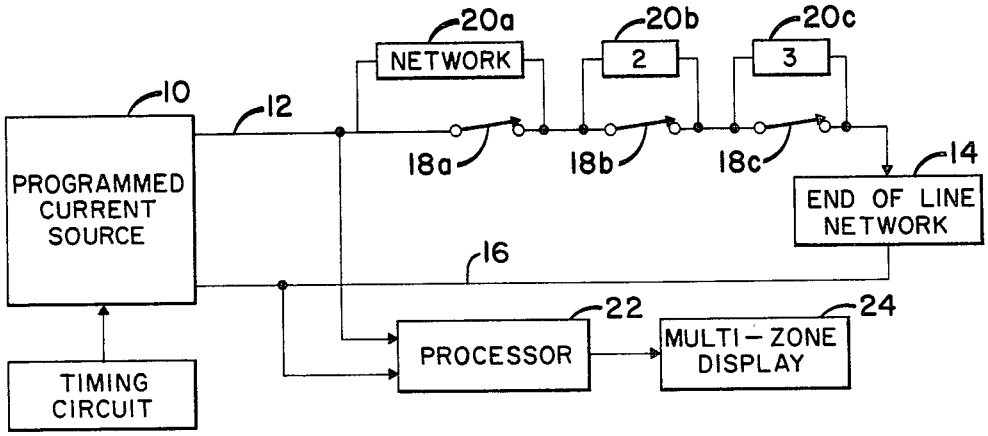
FIG. 1 is a diagrammatic representation of a multi-zone alarm system embodying the invention.

Referring to FIG. 1 there is shown a programmed current source 10 connected to an alarm loop which is composed of an outgoing conductor 12 and a return conductor 16 terminating in an end of line network 14. A plurality of normally closed alarm switches 18 are connected in series in conductor 12. A plurality of networks 20 are provided each connected in parallel with respective alarm switches 18. Thus, in the illustrated embodiment, network 20*a* is connected across switch 18*a*, network 20*b* is connected across switch 18*b* and network 20*c* is connected across switch 18*c*. While three alarm switches and associated networks are illustrated in the embodiment of FIG. 1, it will be appreciated that in practice any number of switches can be employed.

The current source 10 is also coupled to a processor 22 which provides an output signal to a multi-zone display 24 which provides an output indication of the zone or zones in which an alarm has occurred. The current source provides typically a rising exponential current which is repetitive at a selected rate.

Figure 2:
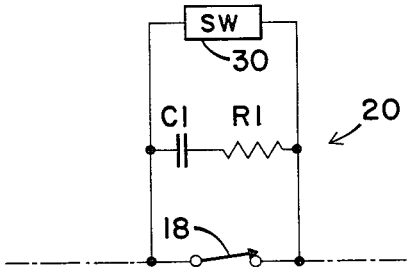
FIG. 2 is a schematic representation of the alarm networks of FIG. 1.

The networks 20 are identical and are implemented by the circuit shown in FIG. 2. An electronic switch 30 is connected in parallel with the associated switch 18, and a series connected capacitor C1 and resistor R1 are connected in shunt with switch 30. The switch 30 can be, for example, a silicon unilateral switch (SUS), a silicon bilateral switch (SBS), a diac, a unijunction transistor or other device or network providing the intended switching characteristic wherein switching between conductive and non-conductive states occurs at a predetermined voltage or current level. The SBS is preferable for installation convenience, since it cannot be connected in wrong polarity; thus, the network containing the SBS can be installed across the switch in either polarity. When switch 18 is open, the loop current is applied to capacitor C1, since the switch 30 is essentially an open circuit below its initial firing voltage. When the capacitor C1 has charged to the firing voltage, typically 8 volts DC, switch 30 is triggered and provides a low impedance through which capacitor C1 discharges and causing a resultant negative voltage step to appear at the input of the loop. This pulse will occur at a time dependent on the capacitance of capacitor C1, and by providing different values of capacitance for respective zones, the different zones will be sensible at different times. The time sequenced outputs from the several zones can be processed to provide both alarm and zone indications.

The switches 18 can be normally closed or normally open. When normally closed, there will be no response or report from a normal (non-alarm) zone. Upon an alarm condition, the corresponding switch 18 is opened, causing triggering of electronic switch 30 as described above, to provide a pulse which denotes the alarm zone. When switches 18 are normally open, the associated electronic switches 30 will be triggered during each polling interval and each zone will therefore issue a report during each polling interval. A missing report signifies an alarm in that zone which did not respond during a polling interval.

The end of line network 14 is the same type of circuit as networks 20 and can be employed across a switch or without an associated switch. This network 14 reports during each polling interval and an associated switch is normally open. The absence of a report from network 14, caused by closure of its switch or by an opened loop, denotes an alarm condition.

Figure 3:
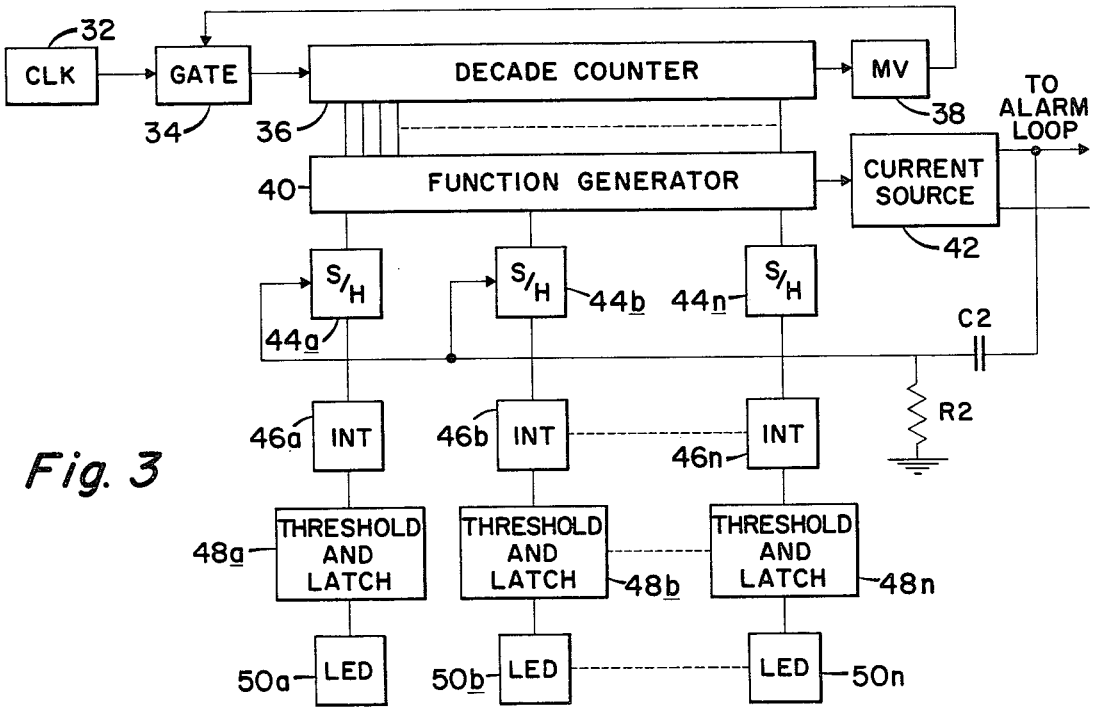
FIG. 3 is a diagrammatic representation of the processor of FIG. 1.

The processor is shown in greater detail in FIG. 3. A clock 32 is coupled via a gate circuit 34 to a decade counter 36, one output of which is applied to a reset multivibrator 38, the output signal of which disables gate 34. The parallel outputs of counter 36 are applied to a function generator 40 the serial output of which is applied to a current source 42 which provides the repetitive exponential current signal to the alarm loop. The decade counter 36 has a plurality of outputs, one for each zone, each enabling a respective sample and hold circuit 44. The sample and hold circuits are coupled to respective integrators 46 which, in turn, are connected to respective threshold and latch circuits 48. Respective light emitting diodes 50 or other suitable indicators are connected to respective circuits 48. The current source output is also coupled via capacitor C2 and shunt resistor R2 to each of the sample and hold circuits 44.

Figure 4:
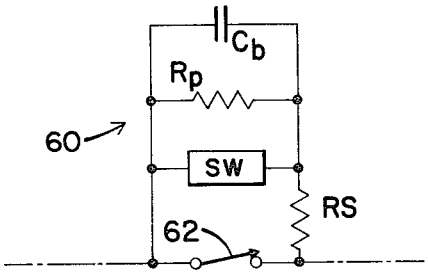
FIG. 4 is a schematic representation of an alternative alarm network for use with the embodiment of FIG. 5.
Figures 5, 6:
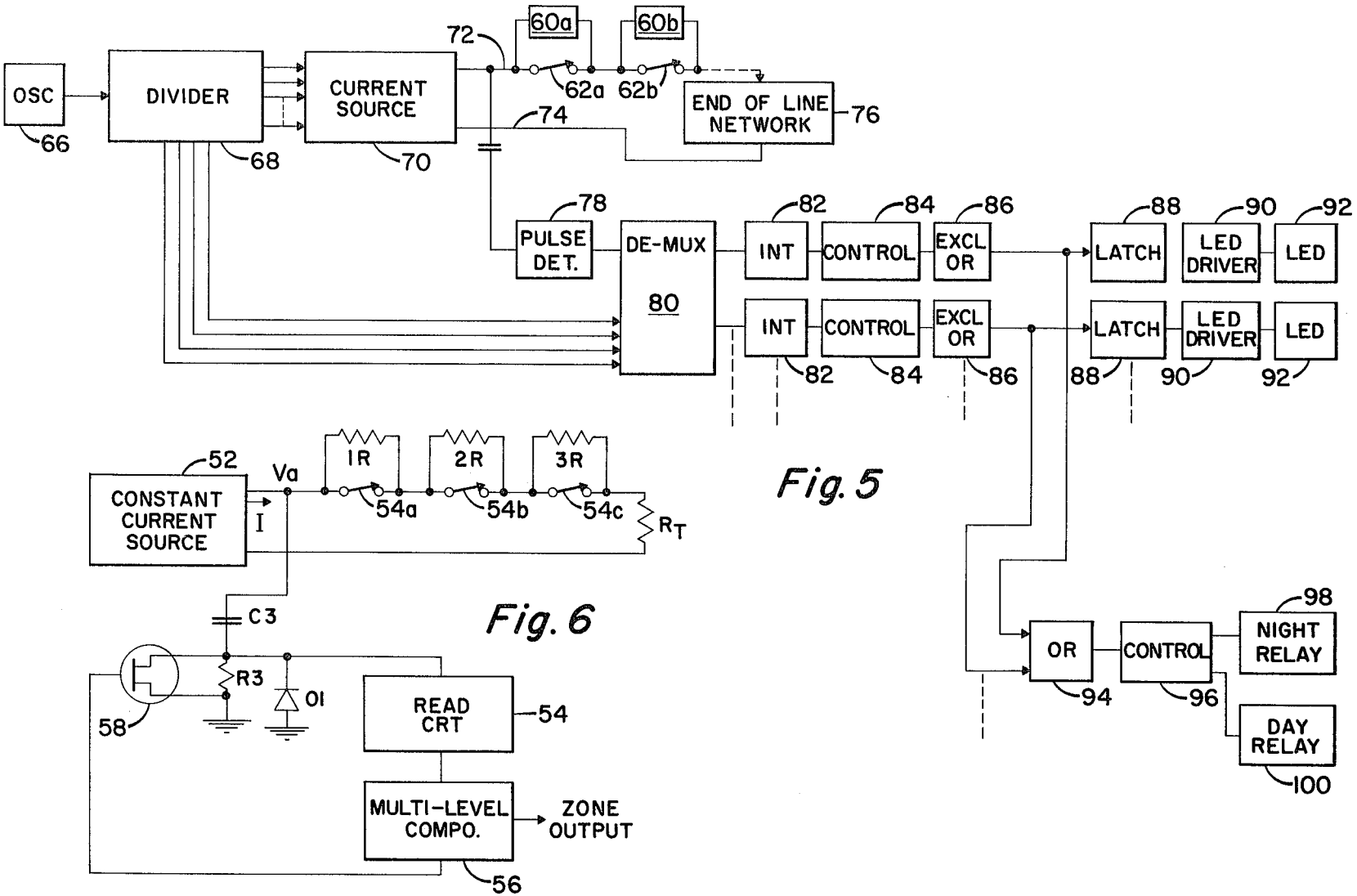
FIG. 5 is a diagrammatic representation of a further embodiment of the invention employing the network of FIG. 4.
FIG. 6 is a diagrammatic representation of an alternative embodiment of the invention.

An alternative embodiment of the invention is shown in FIGS. 4 and 5 wherein a current ramp is provided in the alarm loop for polling of the networks associated with the respective alarm switches. The network 60 is shown in FIG. 4 and includes in parallel with the alarm switch 62 a resistor $R_p$ and an electronic switch 64 which can be an SBS or other device described above in connection with switch 30. A bypass capacitor $C_b$ is provided in shunt with the switch 64 to prevent radio frequency interference and switching transients from triggering the switch 64. A small resistance is provided by resistor $R_s$ to limit the capacitor discharge current to prevent damage to the switch contacts. The resistor $R_p$ is of a different resistance value for each associated sensor to provide triggering of switch 64 at a time denoting the identity of the associated zone.

Referring to FIG. 5, an oscillator 66 provides clock signals to a divider circuit 68 which provides timing signals to a current source 70 which provides a ramp current to the alarm loop composed of conductors 72 and 74. An end of line network 76, of the same type as network 60, is provided as a termination for the loop. The oscillator 66 provides a clock signal of convenient frequency, typically 26.3 kHz, while the divider 68 provides signals of convenient lower frequency, typically 51.4 Hz. The divider output signals are converted by current source 70 into a staircase current signal for application to the alarm loop.

Conductor 72 is AC coupled via a capacitor $C_5$ to a pulse detector 78 which in turn provides pulses to a demultiplexer 80. An address code is provided by divider 68 to the demultiplexer to identify the position along the staircase signal and therefore the time at which pulses are received. The demultiplexer is coupled to a plurality of integrators 82 each associated with a respective one of the alarm switches 62. Each integrator 82 is coupled to a control circuit 84, which is adjustable to accommodate normally open or normally closed alarm switch contacts, and then to an exclusive OR circuit 86. Each exclusive OR circuit 86 is coupled to a latch circuit 88, the output of which is coupled to an LED driver 90 coupled to respective LED or other output indicators 92. The outputs from each of the exclusive OR circuits 86 are also coupled to respective inputs of an OR gate 94, the output of which is applied to a control circuit 96 which provides output signals to a night relay and a day relay 100 which comprise the alarm relay circuits of the overall system.

When the current provided by current source 70 in the alarm loop exceeds the trigger current of a network 60, a negative going voltage pulse is sent back to the annunciator circuitry at a time corresponding to the point on the current ramp at which the particular network is triggered. The received pulse coupled via capacitor $C_5$ to pulse detector 78 which is operative to discriminate between spurious signals and to provide, in response to a received pulse of predetermined amplitude and length, an output signal to demultiplexer 80. The demultiplexer is operative in response to the timing of the received pulse, as determined by the address code from divider 68, to provide a signal to the integrator 82 associated with the alarm switch, the activation of which has been sensed by the corresponding network 60. An open alarm switch contact causes pulses to discharge the integrator for that zone to provide a logic zero output. A closed contact causes its integrator to charge up to a logic one state. The integrator output is applied to an exclusive OR gate 86 which can be programmed via control circuit 84 to allow for either normally open or normally closed switch contacts. The output of the exclusive OR gate goes low upon an alarm condition and the output signal is coupled via OR gate 94 to control circuit 96 for actuation of one or both of the alarm relays 98 and 100. The output of the energized exclusive OR gate 86 is also coupled to associated latch circuit 88 which energizes driver 90 for illuminating the associated LED 92 to indicate the zone in which an alarm has occurred. The LED's may be continuously illuminated or can be operated in a blinking mode.

An embodiment of the invention is shown in FIG. 6 and comprises a constant current source 52 connected to the alarm loop, which includes an end of line terminating resistor $R_7$. The alarm loop includes a plurality of alarm switches 54, across each of which is connected a respective resistor of a predetermined resistance value to represent a particular zone. A resistor 1R is connected across switch 54*a*, a resistor 2R is connected across switch 54*b* and a resistor 3R is connected across switch 54*c*. The constant current source is also connected by way of a capacitor C3 to a read circuit 54, the output of which is applied to a multi-level comparator 56 which provides a signal indication of which zone has an alarm condition. The comparator 56 is connected to an electronic switch 58 which is also connected to capacitor C3 and, by means of a resistor R3, to ground.

The voltage $V_a$ is the product of a constant current I and the sum of all resistors across open alarm contacts. When an alarm contact opens, the voltage $V_a$ will step by an amount equal to $I\Delta R$, where $\Delta R$ is the resistance change occassioned by presence of the particular alarm resistors. This voltage step is coupled via capacitor C3 to resistor R3, the voltage across resistor R3 being sensed by a read circuit 54 which provides a signal to a multi-level comparator 56 which is operative to compare the received signal level with its internal threshold levels and provide an output signal representative of the associated zone represented by the sensed signal level. After providing a zone output, the voltage across resistor R3 is dumped by closure of switch 58 thereby grounding the junction between resistor R3 and capacitor C3. The switch 58 is then returned to its open state to enable the sensing of another alarm condition.

When an alarm switch 54 recloses, there will be a negative voltage step which is clamped by a diode D1 to prevent a false reading of the negative step. The system can also operate with normally open switches to detect switch closure as an alarm condition.

The invention is not to be limited except as indicated in the appended claims.

What is claimed is:

1. For use in a multi-zone alarm system having a two-wire alarm loop, a plurality of alarm sensors each including a pair of alarm switch contacts in series with the loop and the selective opening or closing of which is in response to and signifies an alarm condition, and a processor at a central location coupled to the loop and operative to indicate an alarm condition in response to alarm signals from any of said switch contacts, the improvement comprising:

a current source coupled to the two-wire alarm loop and operative to provide a predetermined current signal in the loop;

a plurality of networks, each connected across a respective pair of alarm switch contacts and operative in response to its switch contact actuation to provide a signal for transmission in the loop to the central location, the signal having a detectable characteristic to denote the identity of the actuated sensor;

circuit means at the central location operative in response to signals from any one or more of the networks to provide a signal indication of the zone in which alarm actuation has occurred;

and wherein said networks each includes an electronic switch in parallel with the associated alarm switch contacts; and a serially connected resistor and capacitor in shunt with the electronic switch.

2. The system of claim 1 wherein the capacitor of each of said networks is of selected different value for each sensor.

3. For use in a multi-zone alarm system having a two-wire alarm loop, a plurality of alarm sensors each including a pair of alarm switch contacts in series with the loop and the selective opening or closing of which is in response to and signifies an alarm condition, and a processor at a central location coupled to the loop and operative to indicate an alarm condition in response to alarm signals from any of said switch contacts, the improvement comprising:

a current source coupled to the two-wire alarm loop and operative to provide a predetermined current signal in the loop;

a plurality of networks, each connected across a respective pair of alarm switch contacts and operative in response to its switch contact actuation to provide a signal for transmission in the loop to the central location, the signal having a detectable characteristic to denote the identity of the actuated sensor;

circuit means at the central location operative in response to signals from any one or more of the networks to provide a signal indication of the zone in which alarm actuation has occurred;

and wherein each of said networks includes an electronic switch in parallel with the associated alarm switch contacts, and a capacitor in shunt with the electronic switch and of a value representing the identity of a switch zone;

and wherein said circuit means includes:

counter means having a plurality of outputs;

a function generator operative in response to the outputs from said counter means to drive said current source for providing a repetitive exponential current signal to the alarm loop;

a plurality of sample and hold circuits each enabled by a respective output from said counter means and each operative to receive signals from any one or more of said networks;

a plurality of integrators each receiving an output from respective ones of said sample and hold circuits; and a plurality of threshold circuits each receiving an output from respective ones of said integrator circuits and each operative to drive an associated indicator for a respective zone.

* * * * *